US007240435B1

(12) United States Patent
Dowdakin

(10) Patent No.: US 7,240,435 B1
(45) Date of Patent: Jul. 10, 2007

(54) CARPENTRY TRIM MARKING GAGE

(76) Inventor: William J. Dowdakin, 609 Matthew Ct., Winnebago, IL (US) 61088

( * ) Notice: Subject to any disclaimer, the term of this patent is extended or adjusted under 35 U.S.C. 154(b) by 140 days.

(21) Appl. No.: 11/126,010

(22) Filed: May 10, 2005

Related U.S. Application Data

(60) Provisional application No. 60/569,748, filed on May 10, 2004.

(51) Int. Cl.
*G01B 5/14* (2006.01)
*E04F 21/00* (2006.01)

(52) U.S. Cl. ..... 33/194; 33/464; 33/42

(58) Field of Classification Search ..... 33/194, 33/464, 42–44, 480, 482, 646–649, 562
See application file for complete search history.

(56) References Cited

U.S. PATENT DOCUMENTS 2,473,639 A * 6/1949 Erickson ..... 33/42
5,123,172 A 6/1992 Thrun
5,737,844 A * 4/1998 Brumley ..... 33/194
5,775,036 A * 7/1998 Stanley, Sr. ..... 33/194
5,940,979 A * 8/1999 Ericksen et al. ..... 33/667
6,305,091 B1 * 10/2001 Tegels ..... 33/194
6,513,258 B1 2/2003 Casner
6,532,674 B2 * 3/2003 Farese ..... 33/194
7,069,659 B1 * 7/2006 Rye ..... 33/194
2003/0131486 A1 * 7/2003 Wallace ..... 33/194
2005/0022397 A1 * 2/2005 Neblo ..... 33/194

* cited by examiner

*Primary Examiner*—Yaritza Guadalupe-McCall
(74) *Attorney, Agent, or Firm*—Reinhart Boerner Van Deuren P.C.

(57) ABSTRACT

An adjustable carpentry trim gage includes a scribing block adjustably attached to a guide block. The guide block includes a guide surface, adapted to be placed against a jamb. The scribing block includes a scribing surface along which a scribing instrument, such as a pencil or an awl, can be drawn to mark guidelines on the jamb, to facilitate installation of a casing on the jamb. The position of the guide block with respect to the scribing block is adjustable to allow the position of the scribing surface on the scribing block, with respect to the guide surface on the guide block, to be set in such a manner that the scribing surface will be placed to indicate a desired reveal on the jamb, when the guide surface is bearing against the jamb. The scribing surface extends beyond the maximum reveal setting of the gage, in a direction parallel to the face of the jamb against which the guide surface is bearing, to facilitate making intersecting guidelines indicating corners of the casing.

21 Claims, 9 Drawing Sheets

CARPENTRY TRIM MARKING GAGE

CROSS-REFERENCE TO RELATED PATENT APPLICATIONS

This patent application claims the benefit of U.S. Provisional Patent Application No. 60/569,748, filed May 10, 2004, the entire disclosure of which is incorporated herein by reference.

FIELD OF THE INVENTION

This invention relates to installing carpentry trim around a window or a door, and more particularly to methods and tools for marking a jamb of a window or door, to facilitate installation of a casing trim around the window or door.

BACKGROUND OF THE INVENTION

As shown in FIG. 1, windows, doors, medicine cabinets, and the like, typically include an outer frame, commonly called a jamb 100, which is installed into a rough opening 102 in a wall 103, by installing a pair of wedge shaped shims 104 between the outside of the jamb 100 and the inner surface of the rough opening 102, and driving one or more finishing nails 106 through the jamb 100 and shims 104, and into framing of the wall 103 that defines the rough opening 102. This process leaves an unsightly gap 108 between the jamb 100 and the rough opening 102 that is typically covered, as shown in FIGS. 2 and 3, with several pieces of carpentry trim, that are known individually and collectively as a window or door casing 110.

Although having to deal with covering the gap 108 is bothersome, the gap 108 is necessitated by the fact that rough openings 102 are generally not square and plumb or closely dimensioned enough to eliminate the gap 108. Door and window jambs 100 must be installed substantially plumb and square, in order for the door or window to operate properly. Even if the rough openings 102 could be made square and plumb, there are also small variations in width and height of the outer periphery of the jambs 100 that would make it necessary to frame the rough opening 102 to much tighter dimensions than can practically be achieved.

The inner periphery of the jambs 100 may also vary slightly over the length and width of the jamb 100, due to small amounts of warpage, or uneven support between the shims 104. There are also unavoidable small dimensional differences in the width and height of the inside dimensions of the jambs 100, from one door or window to the next, even in doors and windows that are of the same nominal width and height.

In order to accommodate the above described variations and dimensional differences, it is also common practice to position the inner edges 111, 112 of the trim pieces 113, 114 forming the casing 110 slightly back from the inner surface 115 of the jamb 100, as shown in FIGS. 2 and 3, to form space known as a reveal 116 that allows a small strip of the face 118 of the jamb 100 to remain exposed, inside of the casing 110, in the finished installation. The reveal 116 allows the position of the casing 110 to be shifted slightly, with respect to the inner surface 115 of the jamb 100, and the opening 102, to compensate for the variations and dimensional differences described above, in a manner that can be readily accomplished by a carpenter installing the casing 100, and in a way that is essentially undetectable to the eye of a casual observer of the finished installation. The reveal 116 also provides an aesthetically pleasing architectural enhancement of the appearance of the installed jamb 100 and casing 110.

In order to cut the trim pieces forming the casing 110 so that they fit together properly and are positioned at a reveal 116 selected to cover the gap 108, it is desirable to have an adjustable trim marking gage for marking guidelines 120, indicating the selected reveal 116, at several points along the face 118 of the jamb 110, as shown in FIG. 4. It is especially desirable to have an adjustable trim marking gage that can conveniently be used for marking intersecting guidelines 120, adjacent to corners 124 of the jamb 100, to create a corner mark 122 precisely indicating where the inside corner 126 of the casing 110 should be located in the finished installation. Once these corner marks 122 are marked on the face 118 of the jamb 100, the dimension between them, and the distance from the corner marks 122 to the floor for a door casing, can be accurately and conveniently measured, and used to cut the parts 113, 114 of the casing 110 so that they will fit together properly in the finished installation.

In the past, carpenters sometimes utilized specially cut blocks of wood, for marking the guidelines 120 and corner marks 122 on the face 118 of the jamb 100. Because these blocks were not adjustable to accommodate the variations and differences described above, it was necessary to continually re-cut the blocks, or cut a separate block for each window or door. This is obviously a very time consuming and wasteful process. It is also necessary, in some cases, to use a different reveal 116 for horizontal trim pieces 113, than is used for vertical trim pieces 114, thereby making the use of specially cut wooden blocks even more difficult.

There have been, in the past, attempts made at providing adjustable carpentry trim marking gages that could be used for marking guidelines 120 and corner marks 122 on the face 118 of a jamb 100. U.S. Pat. Nos. 6,513,258; 5,737,844; and 5,123,172 show several prior approaches to providing an adjustable carpentry trim gage. None of these prior adjustable gages are entirely satisfactory for the desired purposes, however.

What is needed is an improved adjustable carpentry trim marking gage and method.

BRIEF SUMMARY OF THE INVENTION

The invention provides an adjustable carpentry trim gage, having a scribing block adjustably attached to a guide block. The guide block includes a guide surface, adapted to be placed against a jamb. The scribing block includes a scribing surface along which a scribing instrument, such as a pencil or an awl, can be drawn to mark guidelines on the jamb, to facilitate installation of a casing on the jamb. The position of the guide block with respect to the scribing block is adjustable to allow the position of the scribing surface on the scribing block, with respect to the guide surface on the guide block, to be set in such a manner that the scribing surface will indicate a desired reveal on the jamb, when the guide surface is bearing against the jamb. The scribing surface extends beyond the maximum reveal setting of the gage, in a direction parallel to the face of the jamb against which the guide surface is bearing, to facilitate making intersecting guidelines indicating corners of the casing.

Other aspects, objectives and advantages of the invention will become more apparent from the following description of the invention, in conjunction with the accompanying drawings.

BRIEF DESCRIPTION OF THE DRAWINGS AND ATTACHMENTS

FIGS. 1–4, as described in more detail above, are prior art, illustrating the type of trim and marking for which the invention is particularly applicable;

Figure 1:
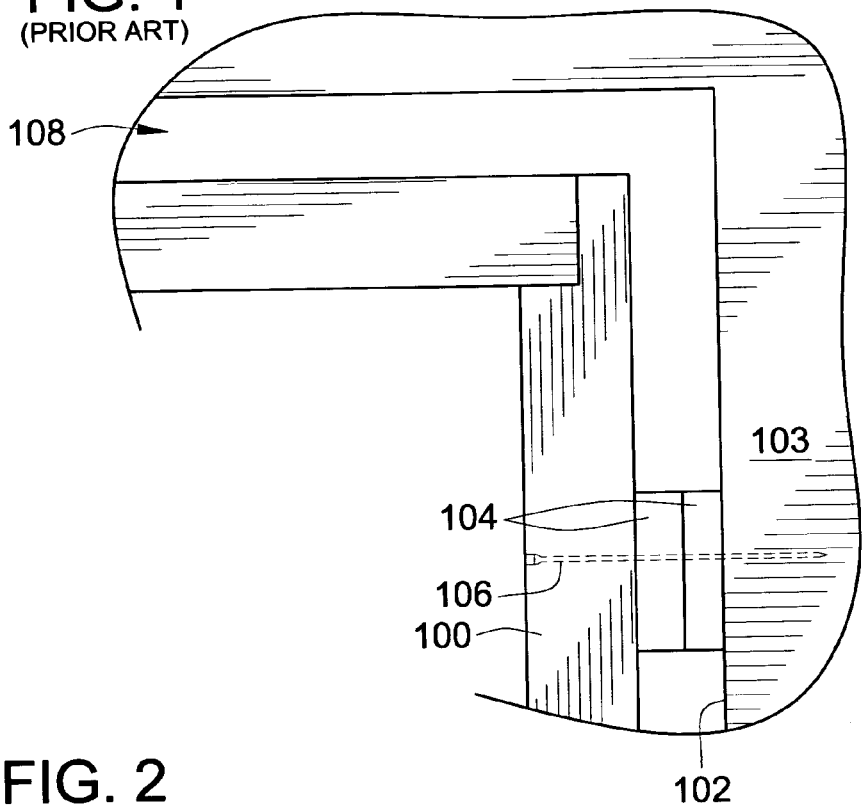
FIG. 1 (PRIOR ART)
Figure 2:
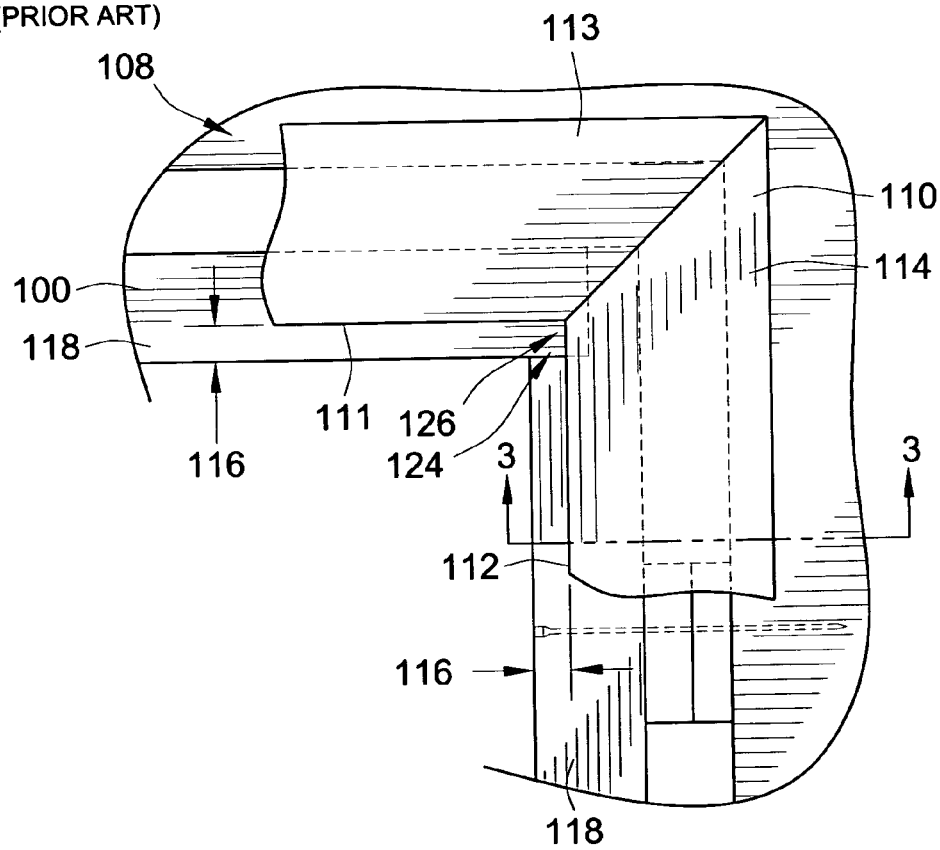
FIG. 2 (PRIOR ART)
Figure 3:
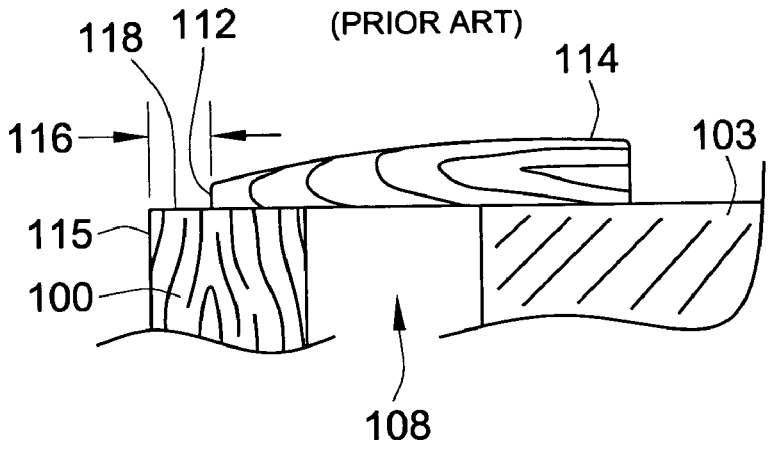
FIG. 3 (PRIOR ART)
Figure 4:
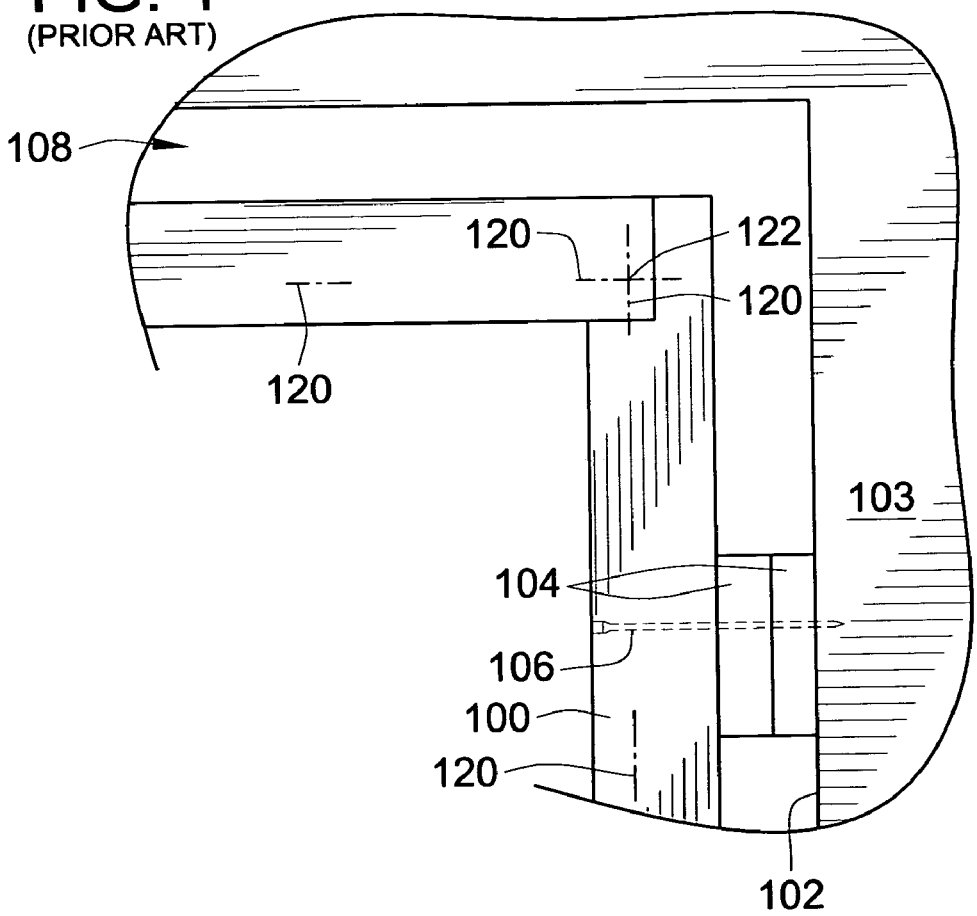
FIG. 4 (PRIOR ART)

While the invention will be described in connection with certain preferred embodiments, there is no intent to limit it to those embodiments. On the contrary, the intent is to cover all alternatives, modifications and equivalents as included within the spirit and scope of the invention. Wherever practical, like reference numbers will be used in the drawings for like and/or substantially similar aspects and features of alternate embodiments of the invention.

DESCRIPTION OF THE INVENTION

Figure 5:
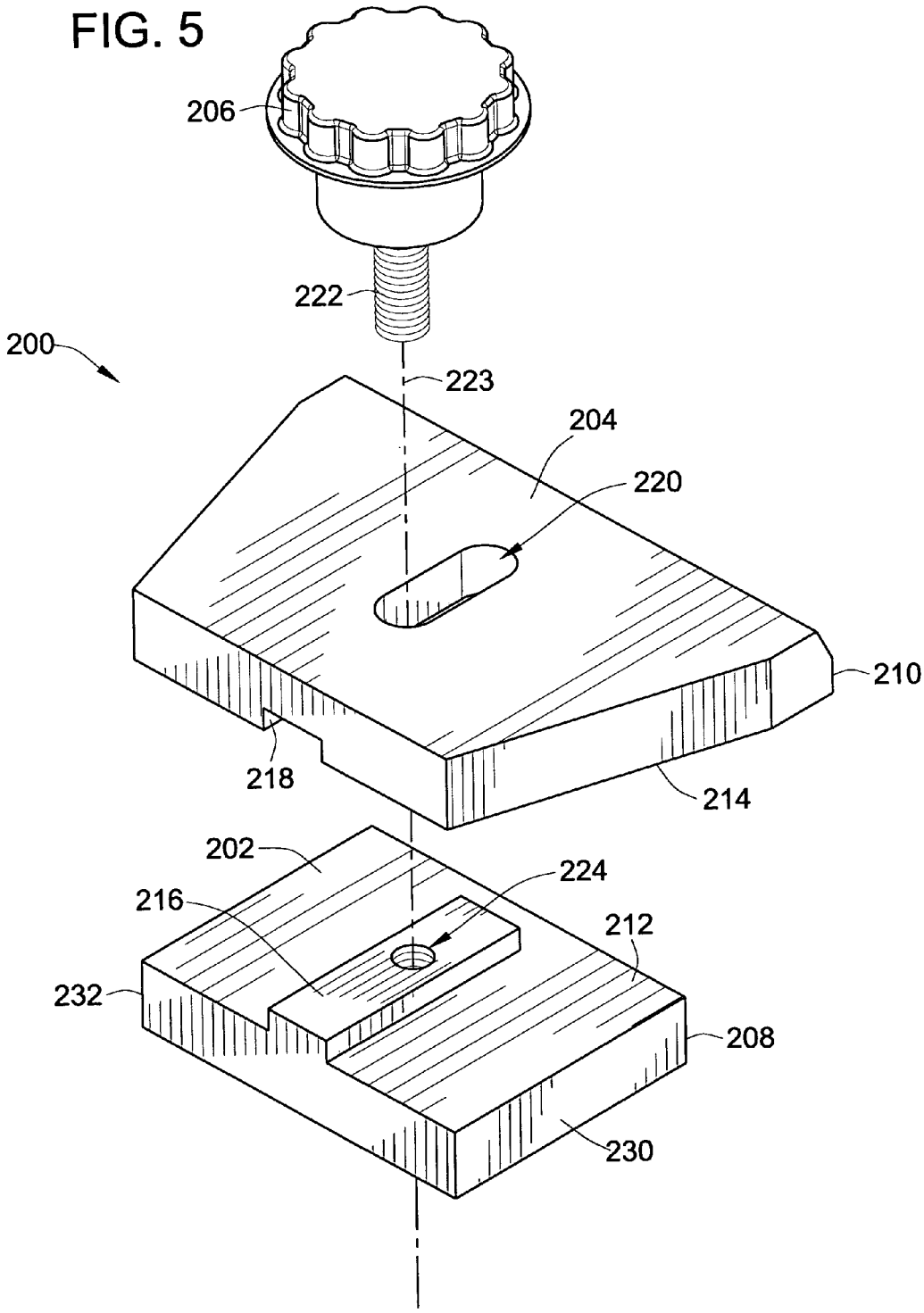
FIGS. 5–8 are perspective views of an exemplary embodiment of the invention.
Figure 6:
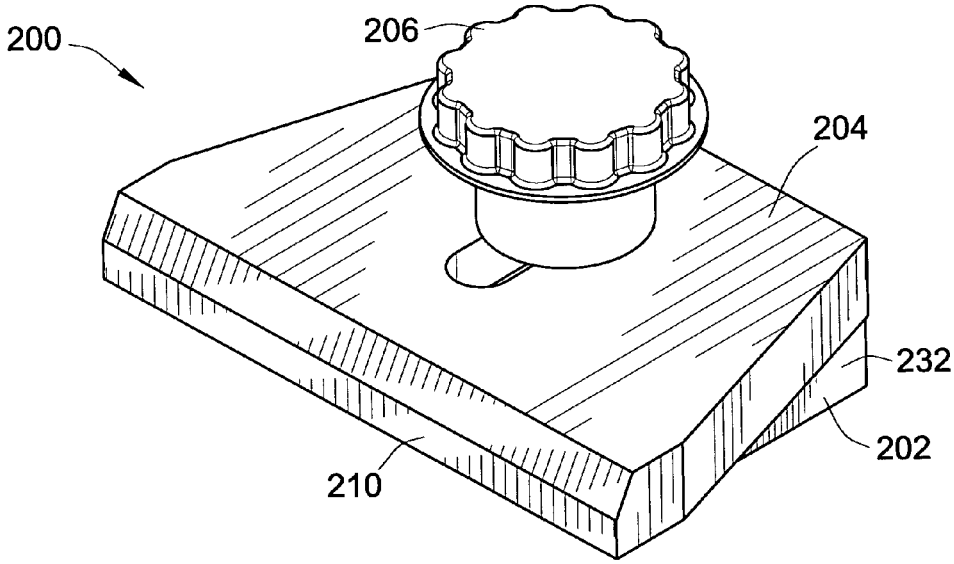
Figure 7:
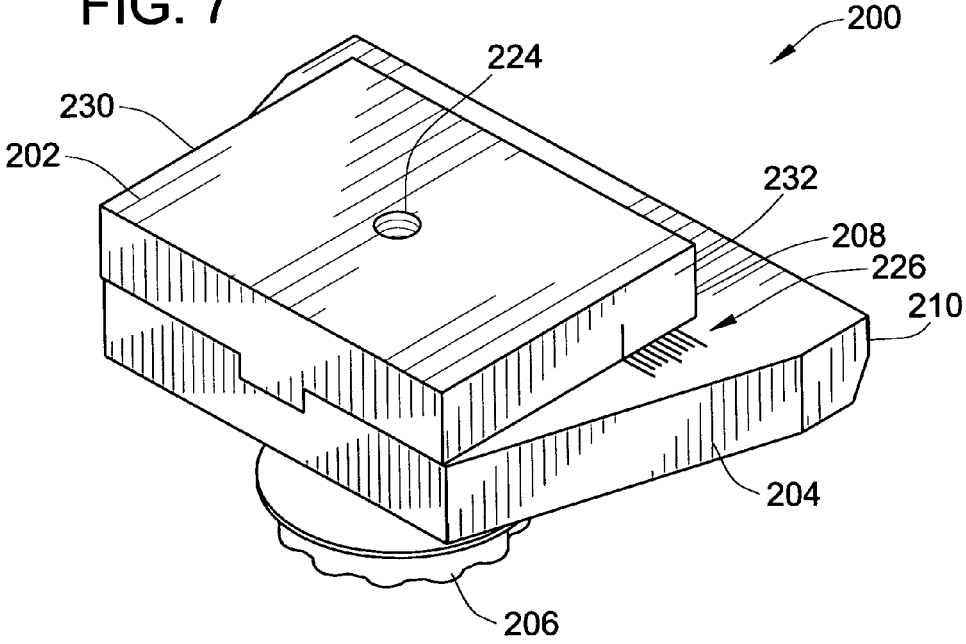

FIG. 5 shows an exemplary embodiment of a trim marking gage 200, according to the invention, having a guide block 202, and a scribing block 204, adjustably attached to one another by an adjustment knob 206. FIGS. 6 and 7 show a top and a bottom view, respectively, of the assembled gage 200. The guide block 202 includes a guide surface 208, extending along one edge of the guide block 202. The scribing block 204 includes a scribing surface 210 that is oriented parallel to the guide surface 208.

Mating surfaces 212, 214, respectively, of the guide block 202 and scribing block 204 include alignment features that orient and guide the scribing surface 210 parallel to the guide surface 208. Specifically, protruding from the mating surface 212 of the guide block 202 is an elongated key 216, which extends in a direction perpendicular to the guide surface 208. The elongated key 216 slidingly engages an elongated slot 218, in the mating surface 214 in the scribing block 204. The elongated slot 218 is oriented perpendicular to the scribing surface 210 of the scribing block 204, and grips the sides of the key 216 snugly enough, so that as the guide block 202 and scribing block 104 are moved relative to one another, the scribing surface 210 is always maintained in a parallel relationship to the guide surface 208.

The scribing block 204 also includes an elongated through-hole 220, intersecting, and having a major axis aligned with the elongated slot 218. The through hole 220 allows passage therethrough of a threaded portion 222, extending from the knob 206. The threaded portion 222, extending from the knob 206, engages a threaded hole 224 in the guide block 202, so that the scribing block 204 and guide block 202 can be clamped together, to hold the scribing surface 210 in a desired position relative to the guide surface 208.

Figure 9:
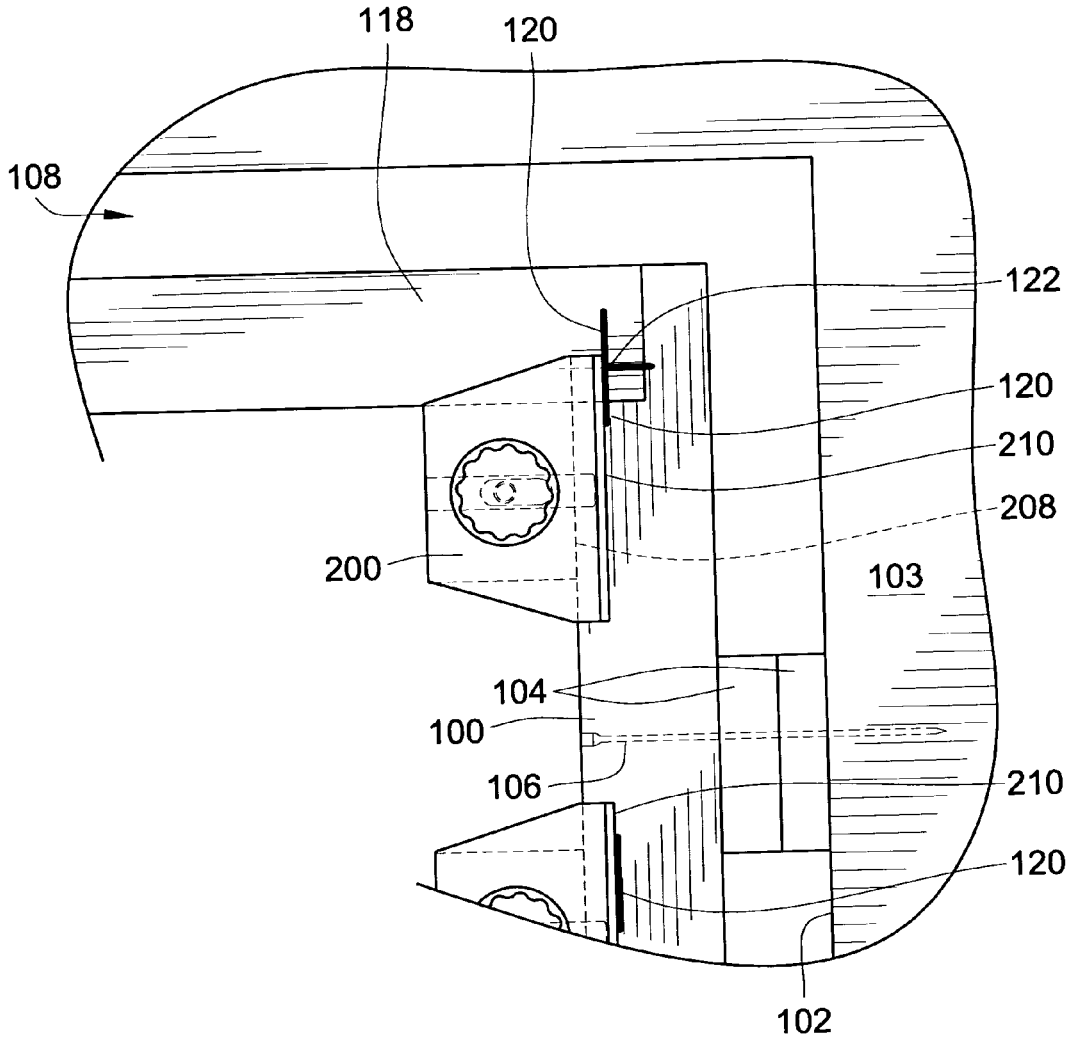
FIGS. 9 and 10 illustrate the manner in which the exemplary embodiment of FIGS. 5–8 is used for marking guidelines on a jamb, to facilitate installation of trim pieces forming a casing.
Figure 10:
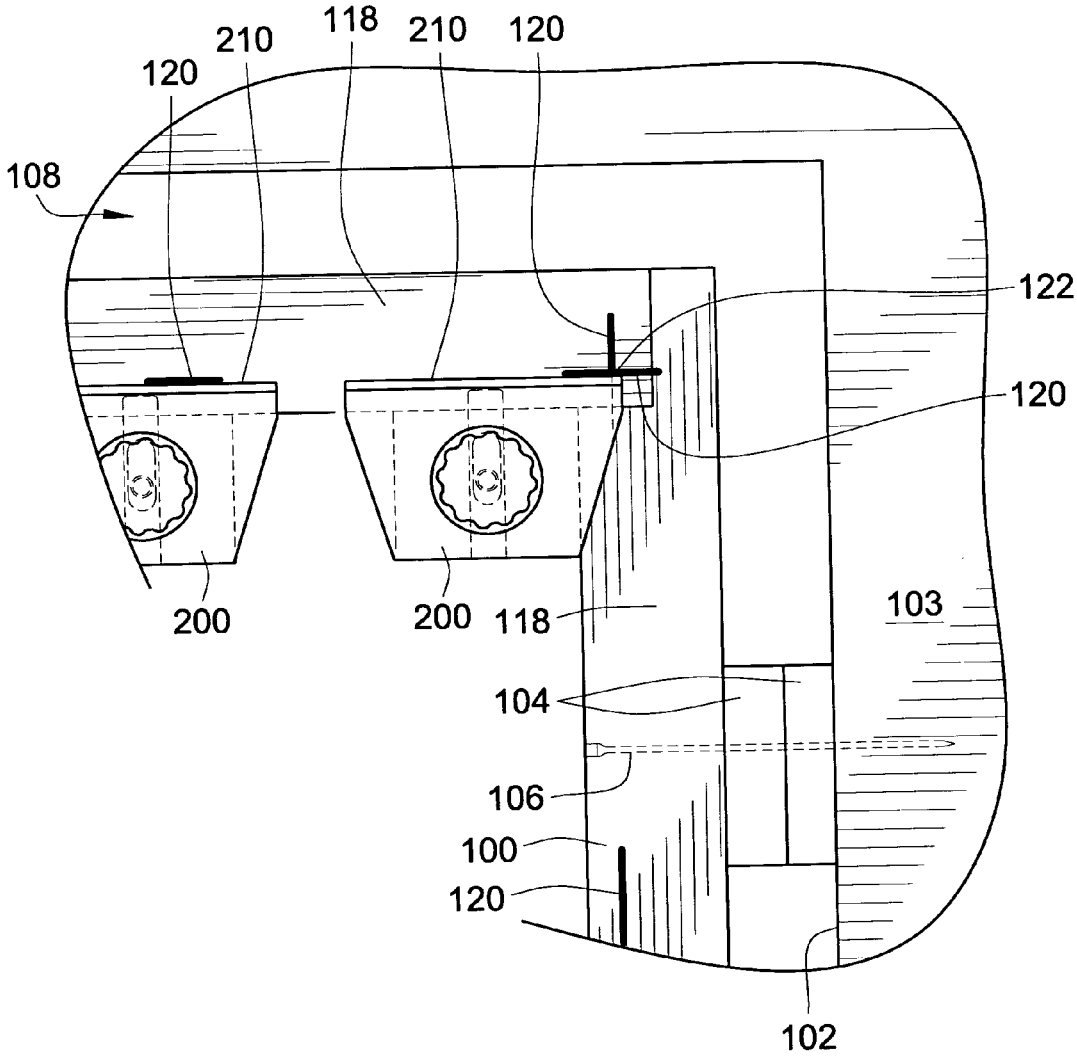

As will be noted in FIG. 7, the scribing block 204 and guide block 202 include marked graduations, as indicated generally at arrow 226, to facilitate setting the scribing surface 210 at a desired distance from the guide surface 208. The set, desired distance places the scribing surface 210 at a proper location so that, when the guide surface 208 is bearing against an inside surface of the jamb 100, as shown in FIGS. 9 and 10, and Attachment 2, a guideline 120, made by scribing along the scribing surface 210 on the face of the jamb 100, will mark the proper position of the edge of the trim pieces making up a casing, to leave a reveal 116 having a width equal to the desired dimension set by the trim gage 200.

Figure 8:
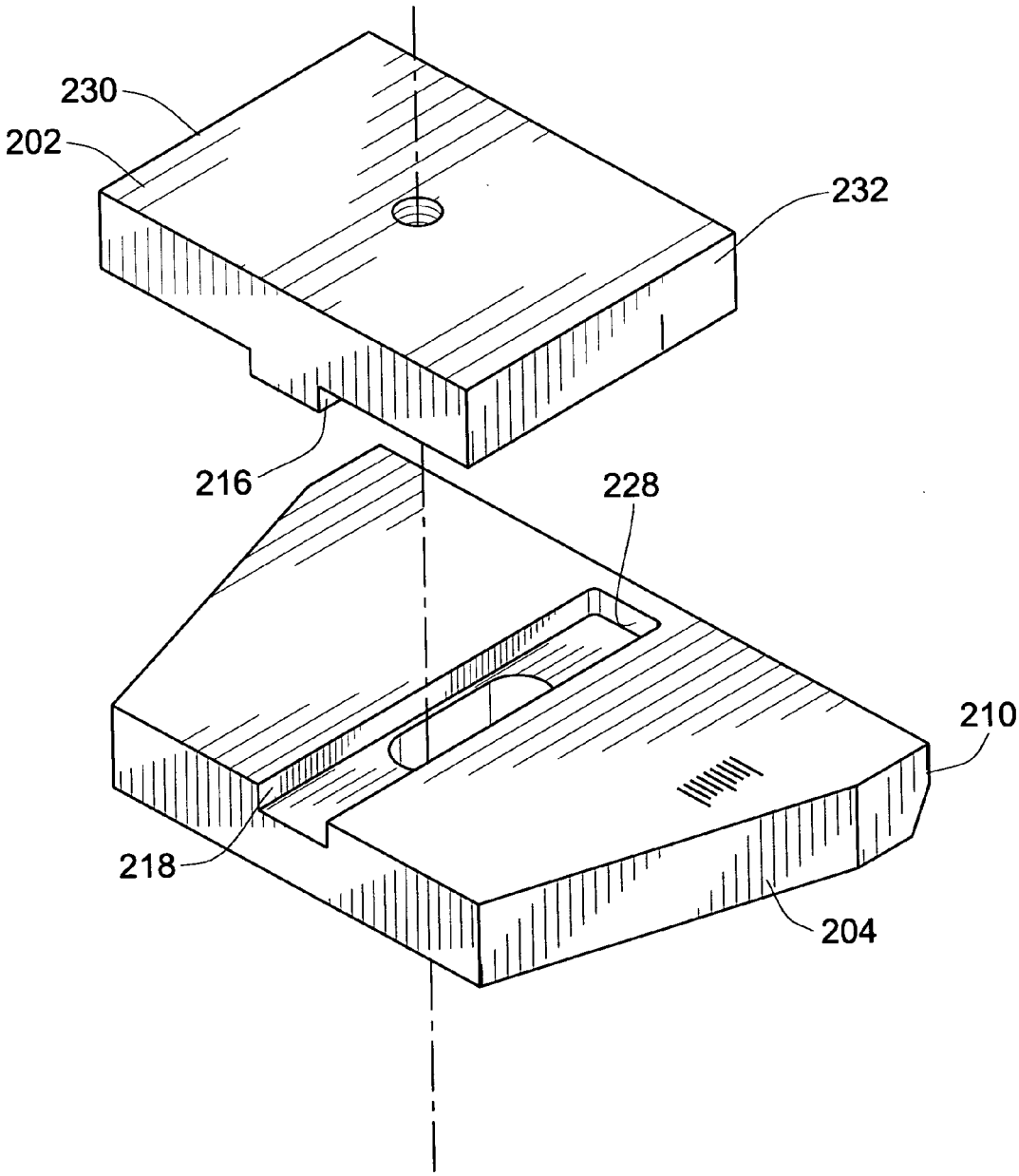

As shown in FIG. 8, it is preferred that the elongated slot 218 be stopped short of the scribing surface 210, to thereby leave an end wall 228 in the elongated slot 218. Having the slot 218 stop short, in this manner, rather than extending to and breaking out through the scribing surface 210, provides a long, unbroken scribing surface 210, to thereby facilitate making guidelines the 120.

The scribing surface 210 also extends beyond opposing sides 230, 232 of the guide block 202, a distance greater than the maximum distance (reveal) that is allowed by the graduations 226, between the scribing surface 210 and the guide surface 208. This aspect of the invention allows intersecting guidelines 120 to be accurately and quickly drawn at the corners of the jamb 100, to form corner marks 122, by placing the gage 200 in the corner of the jamb 100, as shown in FIGS. 9 and 10, and as described in Attachment 2, with the guide surface 208 bearing first against one of the inside faces of the jamb at the corner, and one of the opposing faces 230 or 232 of the guide block 202 bearing against the other inside face of the jamb at the corner, and then rotating the gage 90 degrees, about an axis of rotation, such as the centerline 223 of the threaded portion 222 extending from the knob 206, and repeating the process to create the intersecting and overlapping guidelines forming the corner marks 122.

Figure 11A:
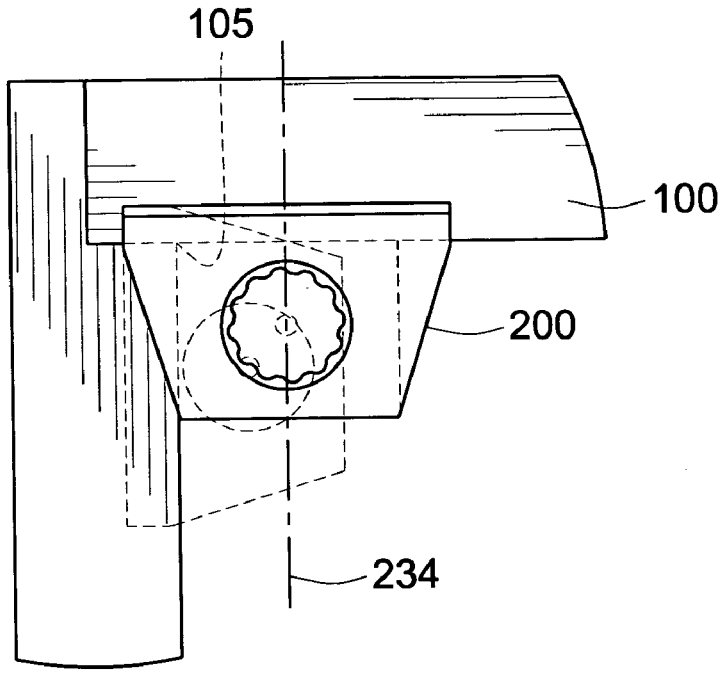
FIGS. 11A and 11B illustrate the manner in which a gage, according to the invention, may be used for marking guidelines for installation of a casing adjacent a left and a right inside corner of a jamb.
Figure 11B:
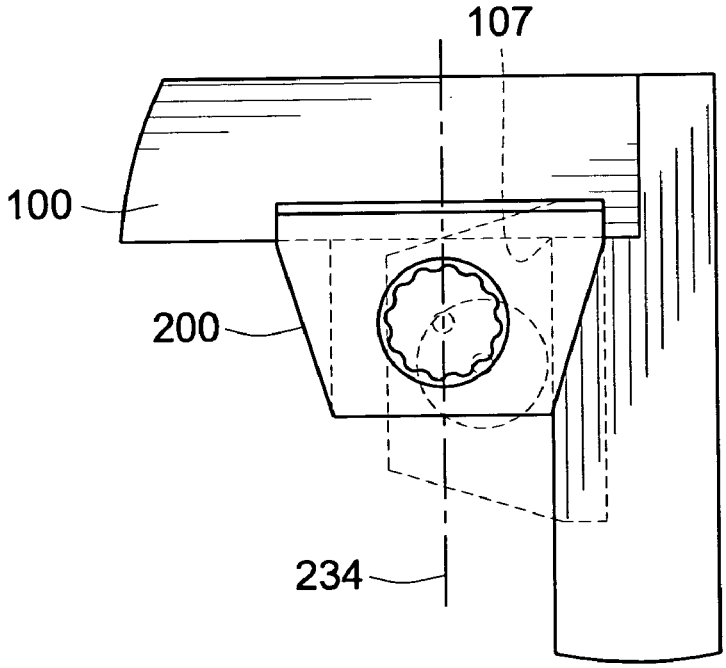

As shown in FIGS. 11A and 11B the exemplary embodiment of the gage 200 is configured to be substantially symmetrical about a centerline 234 extending generally perpendicular to the guide surface 208, and substantially coincident with the major axis of the elongated slot 218. The symmetrical configuration of the exemplary embodiment of the gage 200 allows the gage 200 to be utilized for marking intersecting centerlines adjacent either the left or the right inside corners 105, 107 of the jamb 100, without disassembly or substantial manipulation of the gage, as was required in some prior marking devices and methods. It will be further noted that the mating surface 214 of the scribing block 204 extends beyond the guide block 202, to thereby form a stabilizing surface adapted to bear against one or more face surfaces of the jamb members, to facilitate positioning and use of the gage 200.

Figure 12:
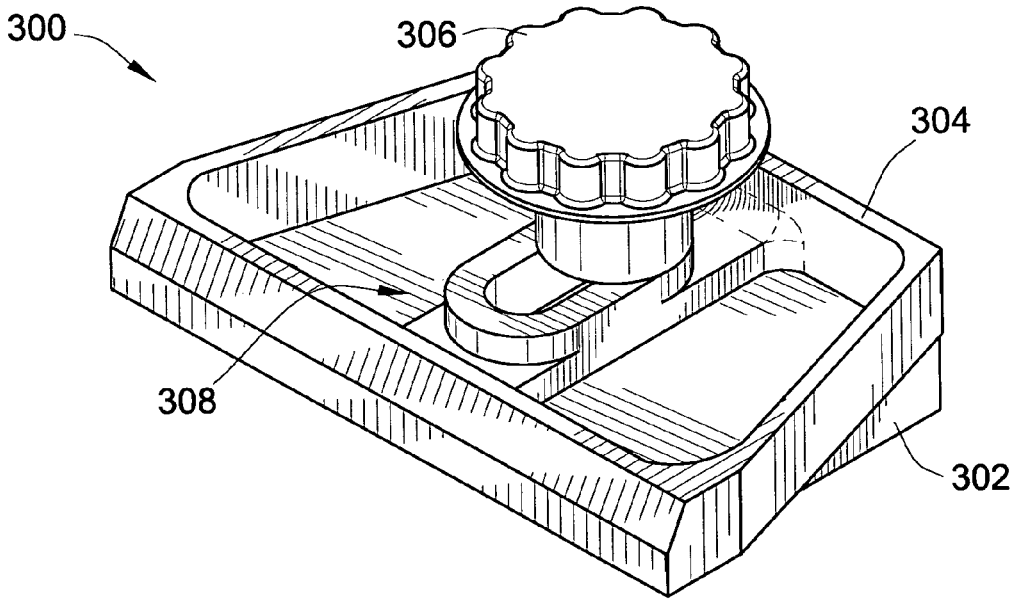
FIGS. 12 and 13 are top and bottom perspective views, respectively, of an alternate exemplary embodiment of the invention.
Figure 13:
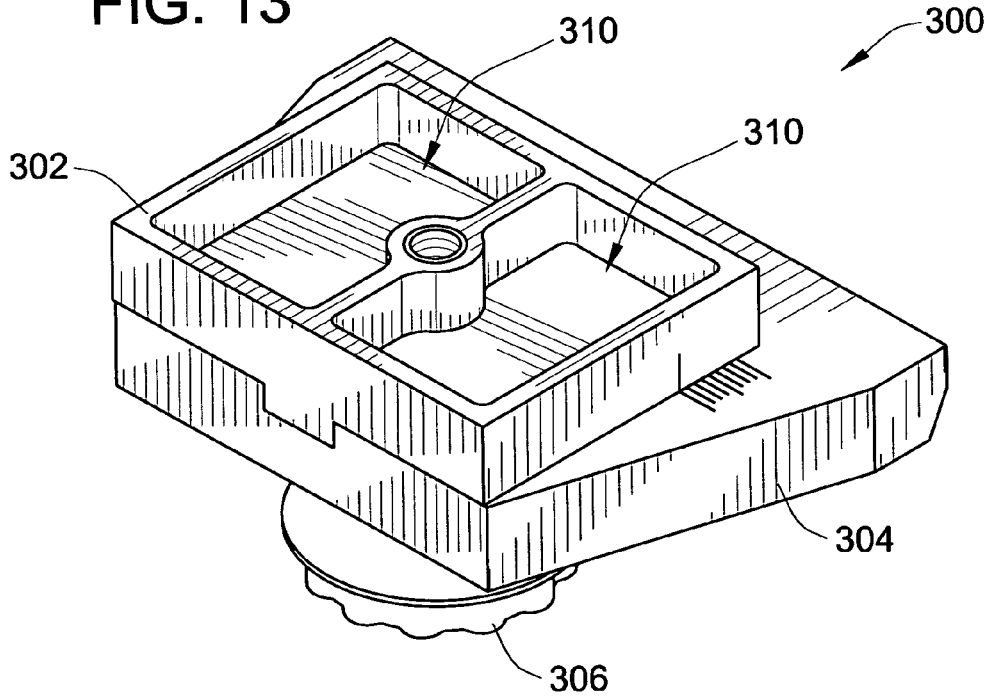

FIGS. 12 and 13 illustrate an alternate embodiment of a trim marking gage 300, according to the invention, having a guide block 302, and a scribing block 304, adjustably attached to one another by an adjustment knob 306. FIGS. 12 and 13 show a top and a bottom view, respectively, of the assembled gage 300. In general, the alternate embodiment of the invention is very similar to the embodiment described above, with the exception that the outer surfaces of the guide block 302 and scribing block 304 have been configured to include sculptured recesses 308, 310 respectively. These recesses 308, 310 provide improved handling of the gage 300 during use, by providing additional surface features which enhance gripping and positioning of the gage 300, and by reducing weight of the gage 300. These recesses 308, 310 also facilitate manufacture of the guide block 302 and the scribing block 304, particularly where those parts are fabricated at least partially by a process such as molding or casting from materials such as plastics, composites, or metal.

The use of the terms "a" and "an" and "the" and similar referents in the context of describing the invention are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any element not expressly described herein as being essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited or suggested herein as permitted by applicable law within the scope of the appended claims. Moreover, any combination of the above-described elements in all possible variations thereof is encompassed by the invention unless otherwise indicated herein or otherwise clearly contradicted by context.

What is claimed is:

1. An adjustable carpentry trim gage for marking guidelines on a jamb for installation of a casing on the jamb, the gage comprising, a scribing block adjustably attached to a guide block:

the guide block including a guide surface adapted to be placed against the jamb, and the scribing block including a scribing surface along which a scribing instrument can be drawn to mark guidelines on the jamb;

the guide block being adjustable with respect to the scribing block to thereby position the scribing surface on the scribing block, with respect to the guide surface on the guide block, in such a manner that the scribing surface will indicate a desired reveal on the jamb, when the guide surface is bearing against the jamb;

the guide block and scribing block including alignment features for orienting and guiding the scribing surface parallel to the guide surface; and the guide block and scribing block further including mating surfaces thereof, with the mating surface of the guide block having, protruding therefrom, an elongated key, which extends in a direction perpendicular to the guide surface, and the mating surface of the scribing block including an elongated slot therein for slidingly receiving the elongated key of the guide block, the elongated slot being oriented substantially perpendicular to the scribing surface of the scribing block, and configured such that as the guide block and scribing block are moved relative to one another, the scribing surface is maintained in a parallel relationship to the guide surface.

2. The adjustable gage of claim 1, wherein one or both of the guide block and the scribing block define an outer surface thereof having one or more recesses therein defining gripping surfaces, to thereby facilitate manipulation and positioning of the gage.

3. The adjustable gage of claim 1, wherein the elongated slot in the mating surface of the scribing block is stopped short of the scribing surface, to thereby leave an end wall in the elongated slot, to thereby provide an unbroken scribing surface 210 and facilitate marking of the guidelines.

4. The adjustable gage of claim 1, wherein the jamb and casing include respective inside corners thereof, and the guide surface and scribing surface are configured for marking intersecting guidelines, crossing over one another and spaced from the inside corner of the jamb, to indicate a desired location for the inside corner of the casing adjacent the inside corner of the jamb.

5. The adjustable gage of claim 4, wherein the jamb defines an inside surface thereof and the scribing and guide blocks are attached to one another in a manner providing relative adjustment between the guide and scribing surfaces up to a maximum reveal setting of the gage, and the scribing surface extends beyond a maximum reveal setting of the gage, in a direction parallel to the inner surface of the jamb against which the guide surface is bearing, to facilitate marking the intersecting guidelines indicating corners of the casing.

6. The adjustable gage of claim 5, wherein the jamb includes a first and a second member thereof, joined to form the inside corner of the jamb, and having respective inside surfaces thereof, with the guide surface of the guide block being configured for bearing successively against the inside surfaces of the first and second jamb members for facilitating successive marking of the intersecting guidelines.

7. The adjustable gage of claim 6, wherein, once the gage is set to provide a selected desired reveal, the scribing surface is positioned for successively marking of the intersecting guidelines at the selected desired reveal on the first and second jamb members, by rotating the gage to successively bring the guide surface to bear against the inside surfaces of the first and second jamb members.

8. The adjustable gage of claim 7, wherein the first and second jamb members define face surfaces thereof extending substantially perpendicular to the inside surfaces thereof, and the gage is configured for rotation about an axis of rotation extending substantially perpendicular to the face surfaces of the jamb members, for successively marking the intersecting guidelines on at least one of the face surfaces of the jamb.

9. The adjustable gage of claim 8, wherein the scribing block extends beyond the guide block and includes a stabilizing surface adapted to bear against the face surface of at least one of the first and second jambs when the guide surface is bearing against an inside surface of at least one of the first and/or second jambs.

10. The adjustable gage of claim 9, wherein the stabilizing surface is adapted to simultaneously bear against the face surfaces of both the first and second jambs, when the guide surface is bearing against the inside surface of the at least one of the first and/or second jambs.

11. The adjustable gage of claim 10, wherein the gage is substantially symmetrically configured about a centerline extending substantially perpendicular to the guide surface, whereby the gage may be utilized for marking the intersecting guidelines on adjacent inside corners of jambs having the second jamb member disposed substantially to either the right or the left of the first jamb member.

12. An adjustable carpentry trim gage for marking guidelines on a face surface of a jamb having first and second jamb members having respective inside surfaces thereof joined to form first and second oppositely facing inside corners of the jamb, the guidelines being provided for facilitating installation of a casing on the jamb, wherein the casing includes inside corners thereof adjacent the inside corners of the jamb, the gage comprising:

a guide block and a scribing block adjustably operatively attached to one another by an adjustment knob;

the guide block having a guide surface thereof extending along an edge of the guide block and adapted for bearing against one of the inside surfaces of the jamb members;

the scribing block having a scribing surface thereof oriented parallel to the guide surface and adapted for guiding a scribing instrument there along for facilitating marking of the guidelines on the jamb;

the guide block being adjustable along an axis of travel, by means of the adjustment knob, with respect to the scribing block to thereby position the scribing surface on the scribing block at a selectively adjustable distance from, the guide surface on the guide block, in such a manner that the scribing surface indicates a desired reveal on the jamb, when the guide surface is bearing against the jamb;

the guide block and scribing block further defining mating surfaces thereof including an alignment feature for orienting and maintaining the scribing surface substantially parallel to the guide surface as the guide block and scribing block are adjusted relative to one another;

the mating surface of the scribing block extending beyond the guide block an adapted to bear against one or more of the face surfaces of the jamb members, to thereby stabilize the gage and facilitate positioning of the gage on the jamb;

the gage being substantially symmetrical about the axis of travel, to thereby allow use of the gage in marking guidelines adjacent either of the oppositely facing interior corners of the jamb;

the guide surface and scribing surface being configured for marking intersecting guidelines, crossing over one another and spaced from the inside corner of the jamb, at the desired reveal on each of the first and second members of the jamb, to indicate a desired location for the inside corner of the casing adjacent the inside corner of the jamb.

13. The adjustable gage of claim 12, wherein, a desired reveal on the first jamb member is different from a desired reveal on the second jamb member.

14. The adjustable gage of claim 13, wherein the scribing and guide blocks are attached to one another in a manner providing relative adjustment between the guide and scribing surfaces up to a maximum reveal setting of the gage, and the scribing surface extends beyond a maximum reveal setting of the gage, in a direction parallel to the inner surface of the jamb against which the guide surface is bearing, to facilitate marking the intersecting guidelines indicating corners of the casing.

15. The adjustable gage of claim 14, wherein:

the jamb includes a first and a second member thereof, joined to form the inside corner of the jamb, and having respective inside surfaces thereof, with the guide surface of the guide block being configured for bearing successively against the inside surfaces of the first and second jamb members for facilitating successive marking of the intersecting guidelines; and once the gage is set to provide a selected desired reveal, the scribing surface is positioned for successively marking of the intersecting guidelines at the selected desired reveal on the first and second jamb members, by rotating the gage about an axis of rotation extending substantially perpendicular to the face surfaces of the jamb members to successively bring the guide surface to bear against the inside surfaces of the first and second jamb members.

16. An adjustable carpentry trim gage for marking guidelines on a face surface of a jamb having first and second jamb members having respective inside surfaces thereof joined to form first and second oppositely facing inside corners of the jamb, the guidelines being provided for facilitating installation of a casing on the jamb, the gage comprising:

a guide block and a scribing block adjustably operatively attached to one another by an adjustment knob;

the guide block having a guide surface thereof extending along an edge of the guide block and adapted for bearing against one of the inside surfaces of the jamb members;

the scribing block having a scribing surface thereof oriented parallel to the guide surface and adapted for guiding a scribing instrument there along for facilitating marking of the guidelines on the jamb;

the guide block being adjustable along an axis of travel, by means of the adjustment knob, with respect to the scribing block to thereby position the scribing surface on the scribing block, with respect to the guide surface on the guide block, in such a manner that the scribing surface indicates a desired reveal on the jamb, when the guide surface is bearing against the jamb;

the guide block and scribing block further defining mating surfaces thereof including an alignment feature for orienting and maintaining the scribing surface substantially parallel to the guide surface as the guide block and scribing block are adjusted relative to one another;

the mating surface of the scribing block extending beyond the guide block an adapted to bear against one or more of the face surfaces of the jamb members, to thereby stabilize the gage and facilitate positioning of the gage on the jamb;

the gage being substantially symmetrical about the axis of travel, to thereby allow use of the gage in marking guidelines adjacent either of the oppositely facing interior corners of the jamb;

the mating surface of the guide block having, protruding therefrom, an elongated key, which extends in a direction perpendicular to the guide surface, and the mating surface of the scribing block including an elongated slot therein for slidingly receiving the elongated key of the guide block, the elongated slot being oriented substantially perpendicular to the scribing surface of the scribing block, and configured such that as the guide block and scribing block are moved relative to one another, the scribing surface is maintained in a parallel relationship to the guide surface.

17. The adjustable gage of claim 16, wherein one or both of the guide block and the scribing block define an outer surface thereof having one or more recesses therein defining gripping surfaces, to thereby facilitate manipulation and positioning of the gage.

18. The adjustable gage of claim 16, wherein the elongated slot in the mating surface of the scribing block is stopped short of the scribing surface, to thereby leave an end wall in the elongated slot, to thereby provide an unbroken scribing surface and facilitate marking of the guidelines.

19. The adjustable gage of claim 16, wherein the casing includes inside corners thereof adjacent the inside corners of the jamb, and the guide surface and scribing surface are configured for marking intersecting guidelines, crossing over one another and spaced from the inside corner of the jamb, to indicate a desired location for the inside corner of the casing adjacent the inside corner of the jamb.

20. The adjustable gage of claim 19, wherein the scribing and guide blocks are attached to one another in a manner providing relative adjustment between the guide and scribing surfaces up to a maximum reveal setting of the gage, and the scribing surface extends beyond a maximum reveal setting of the gage, in a direction parallel to the inner surface of the jamb against which the guide surface is bearing, to facilitate marking the intersecting guidelines indicating corners of the casing.

21. The adjustable gage of claim 20, wherein:

the jamb includes a first and a second member thereof, joined to form the inside corner of the jamb, and having respective inside surfaces thereof, with the guide surface of the guide block being configured for bearing successively against the inside surfaces of the first and second jamb members for facilitating successive marking of the intersecting guidelines; and once the gage is set to provide a selected desired reveal, the scribing surface is positioned for successively marking of the intersecting guidelines at the selected desired reveal on the first and second jamb members, by rotating the gage about an axis of rotation extending substantially perpendicular to the face surfaces of the jamb members to successively bring the guide surface to bear against the inside surfaces of the first and second jamb members.

* * * * *